US006266969B1

(12) United States Patent
Malnati et al.

(10) Patent No.: US 6,266,969 B1
(45) Date of Patent: Jul. 31, 2001

(54) DEVICE FOR DEFROSTING EVAPORATOR IN A REFRIGERATOR COMPARTMENT

(75) Inventors: Roberto Malnati, Buguggiate; Stefano Tavolazzi, Verbania Intra; Luigi Sessa, Comabbio; Paolo Sicher; Salvatore De Caprio, both of Varese; Silvano Monti, Buguggiate; Daniele Ragazzon; Valerio Bresolin, both of Bassano del Grappa, all of (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/449,386

(22) Filed: Nov. 24, 1999

(30) Foreign Application Priority Data

Nov. 27, 1998 (IT) ..... MI980773 U

(51) Int. Cl.[7] ..... F25D 21/06
(52) U.S. Cl. ..... 62/275; 62/272
(58) Field of Search ..... 62/275, 276, 272

(56) References Cited

U.S. PATENT DOCUMENTS 2,802,346 * 8/1957 Simmons ..... 62/126
2,987,601 * 6/1961 Levin ..... 219/19
4,951,384 * 8/1990 Jacobs et al. ..... 29/611
5,166,658 * 11/1992 Fang et al. ..... 338/23
5,339,644 * 8/1994 Singh ..... 62/234
5,765,384 * 6/1998 Carlstedt et al. ..... 62/276

* cited by examiner

*Primary Examiner*—Michael Powell Buiz
*Assistant Examiner*—Melvin Jones
(74) *Attorney, Agent, or Firm*—Stephen D. Krefman; Robert O. Rice; Joel M. Van Winkle

(57) ABSTRACT

A device for rapidly defrosting a refrigerator compartment, such as a freezer compartment or the like, said compartment comprising a plurality of adjacent walls, in correspondence with at least one of said walls there being arranged a hairpin coil evaporator for a static refrigerator, or a part of an evaporator of forced-air type, within a refrigeration circuit comprising a motor-compressor unit, said device comprising heating means arranged in correspondence with at least one of said walls and/or with the evaporator, said heating means being electrically powered via an electrical supply circuit associated with the refrigerator; the heating means are at least one resistance element of PTF (polymer thin/thick film) type.

17 Claims, 3 Drawing Sheets

DEVICE FOR DEFROSTING EVAPORATOR IN A REFRIGERATOR COMPARTMENT

BACKGROUND OF THE INVENTION

1. Field of the Invention

This invention relates to a device for rapidly defrosting a refrigerator compartment in accordance with the introductory part of the main claim.

2. Description of the Related Art

As is well known, devices for rapidly defrosting a refrigerator compartment, for example the freezer compartment, have been commercially available for some time. These devices comprise for example one or more armoured resistance elements associated with the evaporator or with its hairpin coils and, in the case of a forced-air refrigerator, with the usual collection member (tray) for the water resulting from defrosting. These resistance elements have a high thermal power which however being localized does not allow properly ample and rapid defrosting of the refrigerator compartment. Moreover, to achieve rapid defrosting, said resistance elements would have to be present in a considerable number on the evaporator. Such a solution is however industrially unattainable.

To the aforegoing it must be added that, as is well known, each refrigerator compartment consists of a substantially parallelepiped cell, for example of aluminum, on the outside of which there is positioned the evaporator hairpin coil which during the operating cycle reduces the temperature within the cell to below 0° C. To prevent ice forming on the cell interior with the passage of time (due to the moisture in the air) and depositing on the walls to reduce the cell efficiency, said refrigeration cells are provided externally with electrical resistance elements which can also be activated manually when required. These resistance elements consist of a resistive wire wound on a polyester support, the whole being covered with a PVC sheath which is inserted into a metal tube extending substantially parallel to the hairpin coil of the evaporator. The latter and said tube are embedded in a layer of foamed material which wraps the cell.

To prevent damage to the foamed layer by overheating of said resistance elements when these are powered to implement defrosting, one or more protection devices must be provided in the power circuit of said resistance elements, for example thermostats which interrupt said power when the temperature of the resistance elements reaches a predetermined value beyond which permanent damage can occur to the foamed material, with resultant diminution in its insulating capacity. Such a circuit therefore becomes considerably complicated with consequent high manufacturing costs.

SUMMARY OF THE INVENTION

An object of the invention is to provide a defrosting device which is improved compared with known devices.

A particular object of the invention is to provide a device of the stated type comprising a control circuit for the heating and defrosting means which does not contain elements for directly or indirectly controlling the temperature of said means, hence making the circuit less costly and more simple to manufacture.

A further object is to provide a device of the stated type which can be easily mounted on the cell defining the refrigerator compartment and which achieves diffused heating of its walls with consequent rapid defrosting thereof at a relatively low temperature without producing high thermal inertia.

These and further objects which will be apparent to the expert of the art are attained by a device in accordance with the accompanying claims.

BRIEF DESCRIPTION OF THE DRAWINGS

The invention will be more apparent from the accompanying drawing, which is provided by way of non-limiting example and on which.

DESCRIPTION OF THE PREFERRED EMBODIMENT

Figure 5:
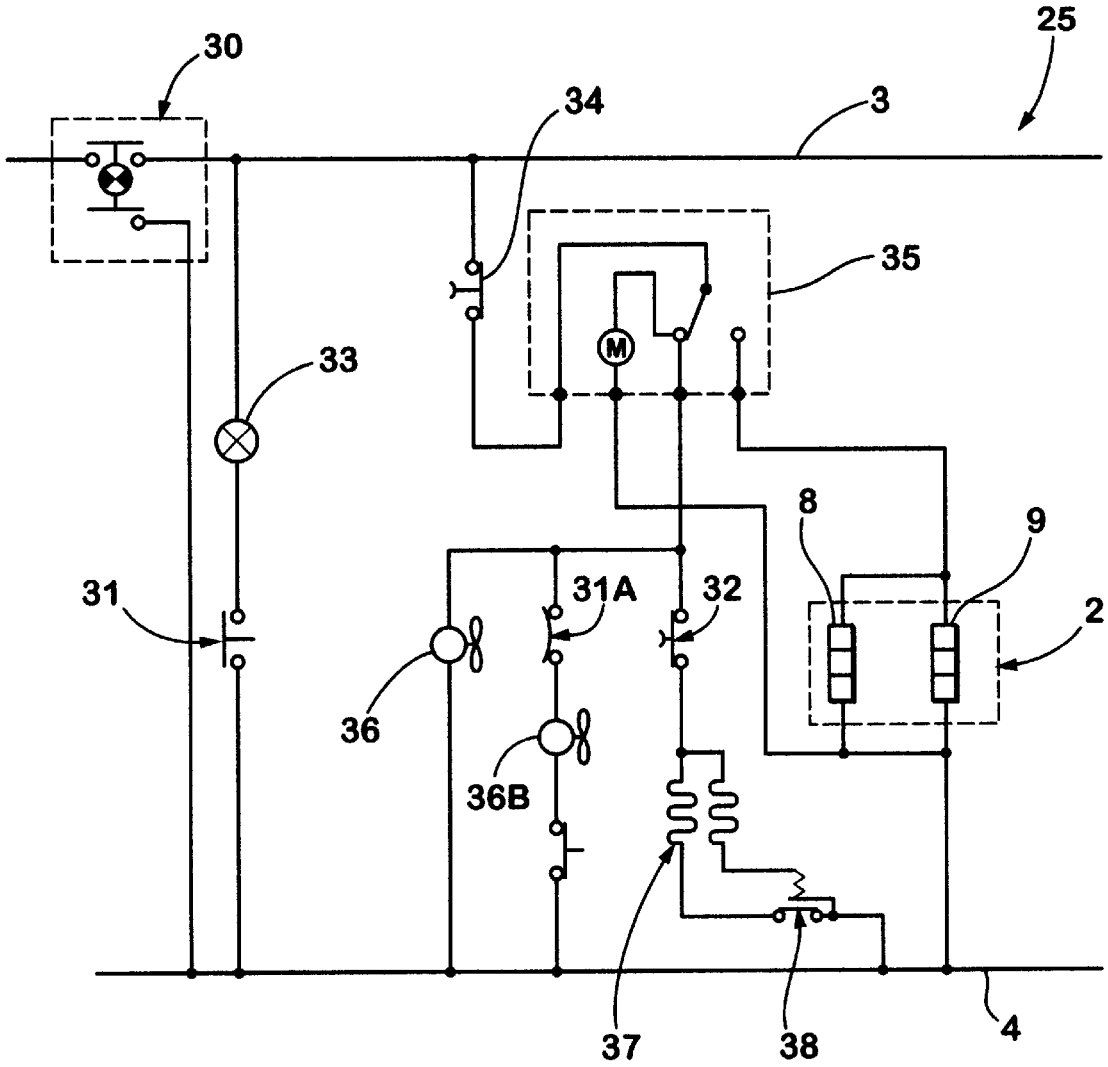
FIG. 5 represents a circuit diagram of the electrical power circuit of the device of the invention.

With reference to said figures, these show a refrigeration cell 1 (usually of aluminum or with walls of another material subsequently aluminized), on the walls of which there are arranged PTF (polymer thin/thick film) resistance elements 2. The cell has a opening 1A on which a door 1B is positioned. The elements or films 2, glued to said walls, are mutually independent and are connected in parallel to each other and to power lines 3 and 4 (see FIG. 5). In this manner a fault in one resistance element does not damage the normal operation of the other elements.

Preferably (see FIG. 2) each resistance element 2 comprises a plurality of superposed flexible sheets or laminas bonded together. Each lamina is of a plastic material, for example polyester or a material containing aramid or similar fibers such as that known by the commercial name of kevlar or kapton. The lamina has surface dimensions substantially corresponding to the dimensions of that wall of the cell 1 with which the element 2 is associated.

By brush deposition, impressing, or silk-screen printing with suitable frames there is applied a resistive ink in strips 5 preferably with PTC (positive temperature coefficient) resistive characteristics in which the temperature does not increase linearly with the applied current, but self-stabilizes beyond a predetermined value, in this case usually 50–60° C. On each sheet there are also provided conductive tracks 6 by brush deposition, impressing or silkscreen printing, for example based on silver or another conducting metal either in the pure state or as an alloy.

The resistive ink consists substantially of a mixture of solid particles of at least one electroconductive material and at least one synthetic resin, dispersed in a solvent. In particular, the electroconductive material is that carbon in the powdered state normally known as carbon black. The carbon can be in the pure state or combined with other electroconductive materials such as nickel, silver, gold, platinum, copper, tin, iron, aluminum or others having an electrical resistivity of less than $0.5\mu\Omega m$.

The synthetic resin is a polymer pertaining preferably to the acetate or fluoroplastic class. Other polymers which can be used include polyolefins, methacrylates and cellulose esters.

The material and resin mixture can be dispersed in a solvent chosen from chlorinated hydrocarbons, esters, ethers, ester-ethers or mixtures thereof.

The connection between the ends of the conductive tracks 6 and the conductive tracks of the adjacent sheets is made by a through metal element 7 which perforates the sheets and electrically connects said ends together.

Figure 1:
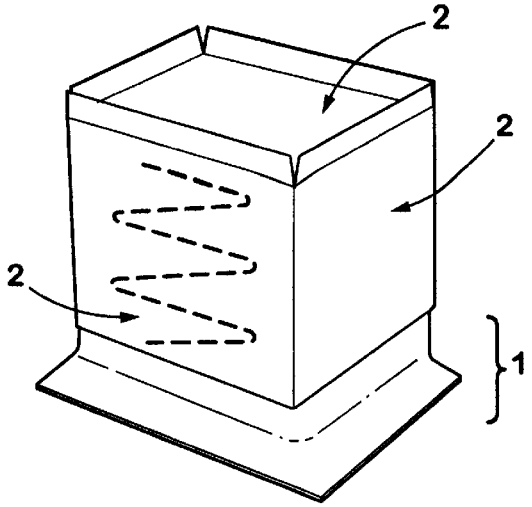
FIG. 1 is a perspective view of a refrigerator cell of static type provided with the device of the invention.
Figure 2:
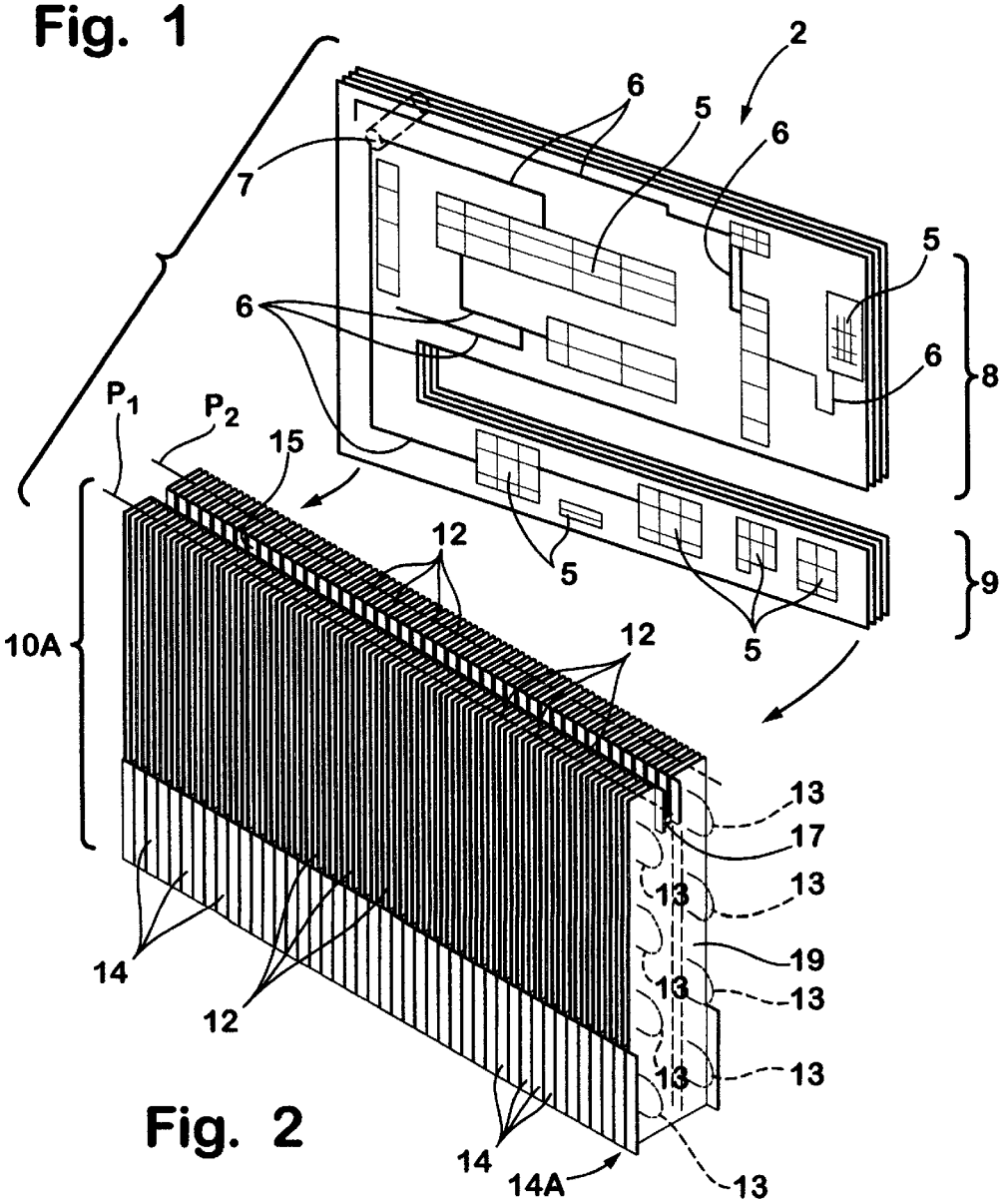
FIG. 2 shows a two-bank evaporator for a forced-air refrigerator with which the device of the invention is associated.
Figure 3:
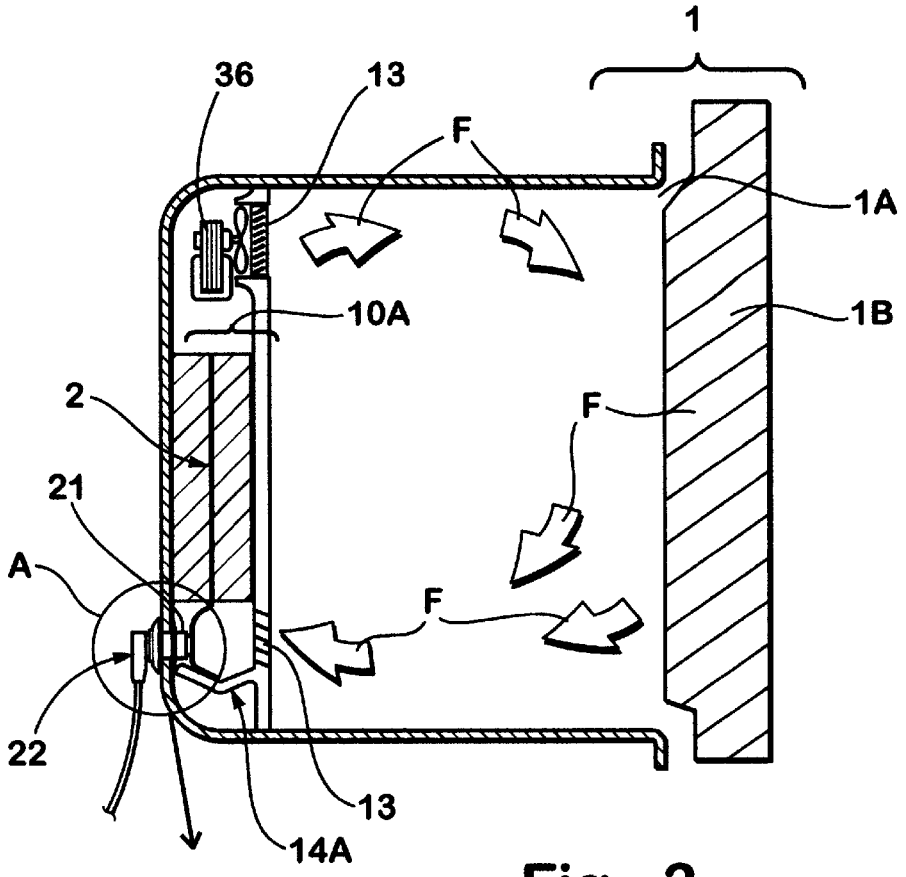
FIG. 3 is a cross-section through a cell of a forced-air refrigerator in which the evaporator is provided with the device of the invention.
Figure 4:
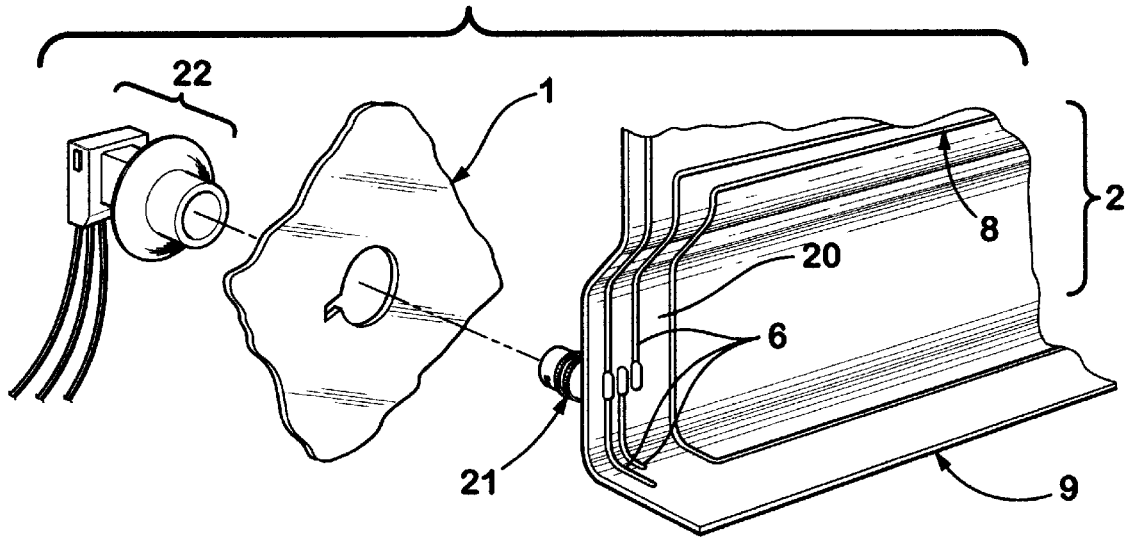
FIG. 4 is an exploded view of the part indicated by A in FIG. 3.

The resistance element can also be associated with an evaporator, for example such as that represented in FIGS. 2 to 4 applied to a refrigerator of forced-air circulation type, said circulation being shown by the arrows F in FIG. 3. In these figures the evaporator is indicated overall by 10A and comprises in known manner a plurality of members 12 (or fins) for heat transfer with the environment in which it is positioned. The elements or fins 12 are positioned on conduits 13 through which the known refrigerant fluid circulates and are arranged in two different parallel planes P1 and P2 (defined in FIG. 2 by the central planes of the fins 12). The fins 12 are of clip-type to enclose the resistance element 2 into intimate contact therewith and are closed lowerly and frontally by cover elements (generally of plastic) connected together to define a tray 14A for collecting the water resulting from defrosting. The fins 12 define an inner interspace (open upwardly and downwardly) which houses the film-type resistance element 2 which is to defrost the evaporator. The element 2, which is brought into intimate contact with the fins 12, comprises a first portion 8 to be positioned between the fins 12 and a second portion 9 to be positioned within the tray 14A. Usual side elements 19 laterally close the interspace 5 on each side.

The element 2 comprises, for example in the lower part of the connection region 20 between its portions 8 and 9, a projecting electrical connection member 21 arranged to cooperate with a known electrical connection member 22 which electrically powers the element 2 and connects it to an electrical circuit 25 which powers each electrical user item of the refrigerator. In known manner this circuit comprises the power lines 3, 4 (phase and neutral), a switch 30 in the line 3, switches 31 and 31A operationally connected to the door 1A, a lamp 33, a defrosting switch or thermostat 34, a timer 35 for activating the electrical defrosting element and for activating the compressor, a motor-compressor unit 37, two fans 36, 36B (for the forced-air refrigerator), usual electrical compressor protection members 32 and 38, and the portions 8 and 9 of the element 2. As can be seen, the power supply to these latter does not comprise any protection element such as thermostats, bimetallic elements, etc.

From the aforegoing it is apparent that the defrosting device of the invention has numerous advantages and in particular:

- it is of limited bulk;
- it does not require the presence of thermal protection elements as the PTF resistance element of PTC type automatically limits its temperature in accordance with its characteristics;
- it enables heat generation to be differentiated depending on where the conductive tracks are positioned relative to the ink strips, or depending on the type of ink used in the element 2;
- it enables the committed power to be reduced because the heat is generated in a diffused rather than localized manner and substantially in contact with the cell surface, so reducing the thermal inertia acting on the foods present in the cell.

By using the aforedescribed device a refrigerator, in particular a static refrigerator, can be provided having a compartment with the said device positioned on its walls. By activating this device any ice formation can be detached from the inner walls of this compartment, so facilitating its complete removal by the user even without waiting for said ice to completely thaw.

We claim:

1. A device for rapidly defrosting a refrigerator compartment, said compartment comprising a plurality of adjacent walls, in correspondence with at least one of said walls there being arranged a hairpin coil evaporator having sections which lie in parallel planes for a refrigerator within a refrigeration circuit comprising a motor-compressor unit, said device comprising:

heating means arranged in correspondence with at least one of said walls with the evaporator, said heating means being electrically powered via an electrical supply circuit associated with the refrigerator, wherein the heating means are at least one film resistance element of PTF (polymer thin/thick film) type, wherein the at least one film resistance element includes a first portion interposed between sections of the evaporator which lie in parallel planes and a second portion positioned at and within a tray for collecting water originating from the defrosting of the evaporator.

2. A device as claimed in claim 1, wherein the resistance element has the characteristics of a PTC resistor.

3. A device as claimed in claim 2, wherein the resistance element includes at least one laminar body on which there is provided a layer of electrically resistive material connected to conductive tracks for electrical power.

4. A device as claimed in claim 3, wherein the layer of electrically resistive material includes at least one strip impressed on the laminar body, which acts as its support.

5. A device as claimed in claim 3, wherein the layer of electrically resistive material includes at least one strip deposited by brush on the laminar body.

6. A device as claimed in claim 3, wherein the flexible laminar body is formed of polyester.

7. A device as claimed in claim 6, wherein the laminar body comprises a plurality of laminar structures mutually superposed and fixed, the conductive tracks of each structure being electrically connected to the tracks of the adjacent structures.

8. A device as claimed in claim 3, wherein the electrically resistive material consists of an ink comprising, dispersed in a solvent, a mixture of solid particles of at least one electrically conductive material and at least one synthetic resin.

9. A device as claimed in claim 8, wherein the conductive material is carbon in the powdered state, normally known as carbon black.

10. A device as claimed in claim 9, wherein the synthetic resin is a polymer pertaining preferably to the acetate, fluoroplastic, polyolefin, methacrylate or cellulose ester class.

11. A device as claimed in claim 8, wherein the mixture of electrically conductive material and resin is dispersed in a solvent chosen from chlorinated hydrocarbons, esters, ethers, ester-ethers or a mixture thereof.

12. A device as claimed in claim 1, further comprising a plurality of film resistance elements associated with corresponding walls of the refrigerator compartment, the resistance elements being connected in parallel to a common electrical power line.

13. A device for rapidly defrosting a refrigerator compartment, said compartment comprising a plurality of adjacent walls, in correspondence with at least one of said walls there being arranged a hairpin coil evaporator having sections which lie in parallel planes for a refrigerator within a refrigeration circuit comprising a motor-compressor unit, said device comprising:

heating means arranged in correspondence with at least one of said walls with the evaporator, said heating means being electrically powered via an electrical supply circuit associated with the refrigerator, wherein the heating means are at least one resistance element of PTF (polymer thin/thick film) type, wherein the resistance element includes at least one laminar body on which there is provided a layer of electrically resistive material connected to conductive tracks for electrical power, wherein the layer of electrically resistive material includes at least one strip silk-screen printed on the laminar body.

14. A device for rapidly defrosting a refrigerator compartment, the compartment including a plurality of adjacent walls, there being arranged within the compartment an evaporator for a refrigerator within a refrigeration circuit including a motor-compressor unit, said device comprising:

a plurality of flexible sheets bonded together, each of the sheets supporting a conductive track connected to a layer of electrically resistive material forming a heating element, wherein each of the conductive tracks are electrically connected in parallel and wherein the plurality of flexible sheets are disposed adjacent the evaporator.

15. The device as claimed in claim 14, further comprising:

a conductor perforating the plurality of flexible sheets and connecting to the conductive tracks formed on each of the plurality of flexible sheets such that each of the layers of electrically resistive material may be supplied with power.

16. The device as claimed in claim 15, wherein the plurality of flexible sheets bonded together form a single, integral body having a first portion and a second portion and wherein the first portion is disposed immediately adjacent the evaporator and the second portion is disposed within the compartment at a location remote from the evaporator.

17. The device as claimed in claim 16, wherein the evaporator is a hairpin coil type evaporator having sections which lie in parallel planes, wherein the first portion of flexible sheets is interposed between sections of the evaporator which lie in parallel planes and the second portion is positioned within a tray for collecting water originating from the defrosting of the evaporator.

* * * * *